US010083682B2

(12) United States Patent
Kojima

(10) Patent No.: US 10,083,682 B2
(45) Date of Patent: Sep. 25, 2018

(54) CONTENT DATA GENERATING DEVICE, CONTENT DATA GENERATING METHOD, SOUND SIGNAL GENERATING DEVICE AND SOUND SIGNAL GENERATING METHOD

(71) Applicant: YAMAHA CORPORATION, Hamamatsu-shi (JP)

(72) Inventor: Hiroyuki Kojima, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/286,015

(22) Filed: Oct. 5, 2016

(65) Prior Publication Data

US 2017/0098439 A1 Apr. 6, 2017

(30) Foreign Application Priority Data

Oct. 6, 2015 (JP) ..... 2015-198652
Oct. 6, 2015 (JP) ..... 2015-198654
Oct. 6, 2015 (JP) ..... 2015-198656

(51) Int. Cl.
*G10H 7/00* (2006.01)
*G10H 7/02* (2006.01)
*G10H 1/18* (2006.01)

(52) U.S. Cl.
CPC ..... *G10H 7/008* (2013.01); *G10H 1/183* (2013.01); *G10H 7/006* (2013.01); *G10H 7/02* (2013.01); *G10H 2250/475* (2013.01)

(58) Field of Classification Search
CPC ..... G10H 7/008; G10H 1/183; G10H 7/006; G10H 7/02; G10H 2250/475
USPC ..... 84/603
See application file for complete search history.

(56) References Cited

U.S. PATENT DOCUMENTS 4,681,008 A * 7/1987 Morikawa ..... G10H 1/0033 84/603
4,783,807 A * 11/1988 Marley ..... G10L 15/02 704/234
4,802,221 A * 1/1989 Jibbe ..... G10L 19/00 704/207
5,321,794 A * 6/1994 Tamura ..... G10H 7/00 704/260
5,440,639 A * 8/1995 Suzuki ..... H04S 1/002 381/17
5,463,183 A * 10/1995 Konno ..... G10H 1/0575 84/604

(Continued)

FOREIGN PATENT DOCUMENTS

JP 2015158527 A 9/2015

*Primary Examiner* — David Warren
*Assistant Examiner* — Christina Schreiber
(74) *Attorney, Agent, or Firm* — Rossi, Kimms & McDowell LLP

(57) ABSTRACT

A content data generating device includes a first storage configured to store content data including at least either video information or audio information, a second storage configured to store variation data representing change of a parameter on the content data, a designator configured to designate a portion of the variation data, and a content data generator configured to process the content data according to a value of the parameter of the portion of the variation data designated by the designator to generate processed content data.

7 Claims, 7 Drawing Sheets

(56) References Cited

U.S. PATENT DOCUMENTS 5,617,507 A * 4/1997 Lee ..... G10L 13/04 704/200
5,740,320 A * 4/1998 Itoh ..... G10L 13/07 704/260
5,744,741 A * 4/1998 Nakajima ..... G10H 1/125 84/622
5,792,971 A * 8/1998 Timis ..... G10H 1/0008 369/83
5,895,449 A * 4/1999 Nakajima ..... G10H 7/002 704/258
5,936,180 A * 8/1999 Ando ..... G10H 7/02 84/603
5,974,387 A * 10/1999 Kageyama ..... G10H 1/361 704/500
6,150,598 A * 11/2000 Suzuki ..... G10H 7/008 84/603
6,169,240 B1 * 1/2001 Suzuki ..... G10H 7/008 704/503
6,255,576 B1 * 7/2001 Suzuki ..... G10H 1/0575 84/604
6,365,817 B1 * 4/2002 Suzuki ..... G10H 7/02 84/603
6,486,389 B1 * 11/2002 Suzuki ..... G10H 1/02 84/603
6,622,207 B1 * 9/2003 Rossum ..... G10H 7/02 711/118
9,792,916 B2 * 10/2017 Shirahama ..... G10L 19/008
2001/0017076 A1 * 8/2001 Fujita ..... G10H 7/02 84/603
2002/0134222 A1 * 9/2002 Tamura ..... G06F 12/121 84/622
2002/0178006 A1 * 11/2002 Suzuki ..... G10H 1/02 704/258
2009/0158919 A1 * 6/2009 Akazawa ..... G10H 7/008 84/622
2010/0236384 A1 * 9/2010 Shirahama ..... G10H 1/183 84/605
2011/0232460 A1 * 9/2011 Shirahama ..... G10H 7/00 84/605
2015/0243291 A1 * 8/2015 Shirahama ..... G10L 19/008 704/500
2017/0061945 A1 * 3/2017 Okazaki ..... G10H 7/04
2017/0098439 A1 * 4/2017 Kojima ..... G10H 7/008

* cited by examiner

CONTENT DATA GENERATING DEVICE, CONTENT DATA GENERATING METHOD, SOUND SIGNAL GENERATING DEVICE AND SOUND SIGNAL GENERATING METHOD

CROSS REFERENCE TO RELATED APPLICATIONS

This application is based on Japanese Patent Application (No. 2015-198652) filed on Oct. 6, 2015, Japanese Patent Application (No. 2015-198654) filed on Oct. 6, 2015 and Japanese Patent Application (No. 2015-198656) filed on Oct. 6, 2015, the contents of which are incorporated herein by reference.

BACKGROUND OF THE INVENTION

1. Field of the Invention

The present disclosure relates to a content data generating device a content data generating method for generating content data. Also, the present disclosure relates to a sound signal generating device a sound signal generating method for generating a sound signal representing an acoustic waveform. In this specification, "content" is defined as information (so-called digital content) including at least either audio information or video information and being transferable via a computer. The audio information is, for example, a musical sound signal that represents an acoustic waveform of a musical sound.

2. Description of the Related Art

As described in JP-A-2015-158527, a musical sound signal generating device is known which can change one element of the sound length (reproduction speed), pitch, and formants without causing any influence on the other elements. In this musical sound signal generating device, waveform data representing an acoustic waveform of an original signal is divided into plural segments and the divided plural segments are subjected to crossfading. The length of each segment is synchronized with the cycle (wavelength of a fundamental tone) of the original signal. The length of a sound is changed by reproducing the same segment repeatedly or skipping one or plural segments regularly. The pitch is changed by changing the length of crossfading (i.e., a deviation between reproduction start times of segments that are superimposed on (added to) each other. The formants are changed by changing the reading speed (i.e., the number of samples that are read out per unit time; in other words, the expansion/contraction ratio in the time axis direction of the segment) of each segment.

An object of the musical sound signal generating device of JP-A-2015-158527 is to change only a particular element while maintaining the features of an original signal as faithfully as possible, and this musical sound signal generating device is not suitable for a purpose of generating an interesting musical sound by processing an original signal.

SUMMARY OF THE INVENTION

The present disclosure has been made to solve the above problem, and an object of the disclosure is therefore to provide a content generating device, a content generating method, a musical sound signal generating device and a sound signal generation method capable of generating an interesting sound that has the features of an original signal to some extent.

The above-described object of the present disclosure is achieved by below-described structures.

(1) There is provided a content data generating device comprising:

a first storage configured to store content data including at least either video information or audio information;

a second storage configured to store variation data representing change of a parameter on the content data;

a designator configured to designate a portion of the variation data; and a content data generator configured to process the content data according to a value of the parameter of the portion of the variation data designated by the designator to generate processed content data.

(2) There is provided a sound signal generating device comprising:

an adder configured to acquire plural sound signals representing sound waveforms respectively and add the acquired sound signals together so that the acquired sound signals are superimposed on each other to generate waveform data representing a waveform of a sound signal;

a storage configured to store the waveform data generated by the adder; and a sound signal generator configured to cut out plural segments, deviated from each other in a time axis of the waveform data, from the waveform data stored in the storage, and generate a sound signal on the basis of waveform data that is generated by crossfading the plural cut-out segments, wherein the sound signal generated by the sound signal generator or a sound signal generated using the sound signal generated by the sound signal generator is stored in the storage.

(3) There is provided a sound signal generating device comprising:

a first sound signal generator configured to cut out plural segments, deviated from each other in a time axis of first waveform data, from the first waveform data representing a waveform of a sound signal and generate a sound signal on the basis of second waveform data that is generated by crossfading the plural cut-out segments of the first waveform data;

a storage configured to store, as third waveform data, a waveform of the sound signal generated by the first sound signal generator; and a second sound signal generator configured to cut out plural segments, deviated from each other in the time axis of the third waveform data, from the third waveform data stored in the storage and generate a sound signal on the basis of fourth waveform data generated by crossfading the plural cut-out segments of the third waveform data.

DETAILED DESCRIPTION OF THE EXEMPLARY EMBODIMENTS

Figure 2:
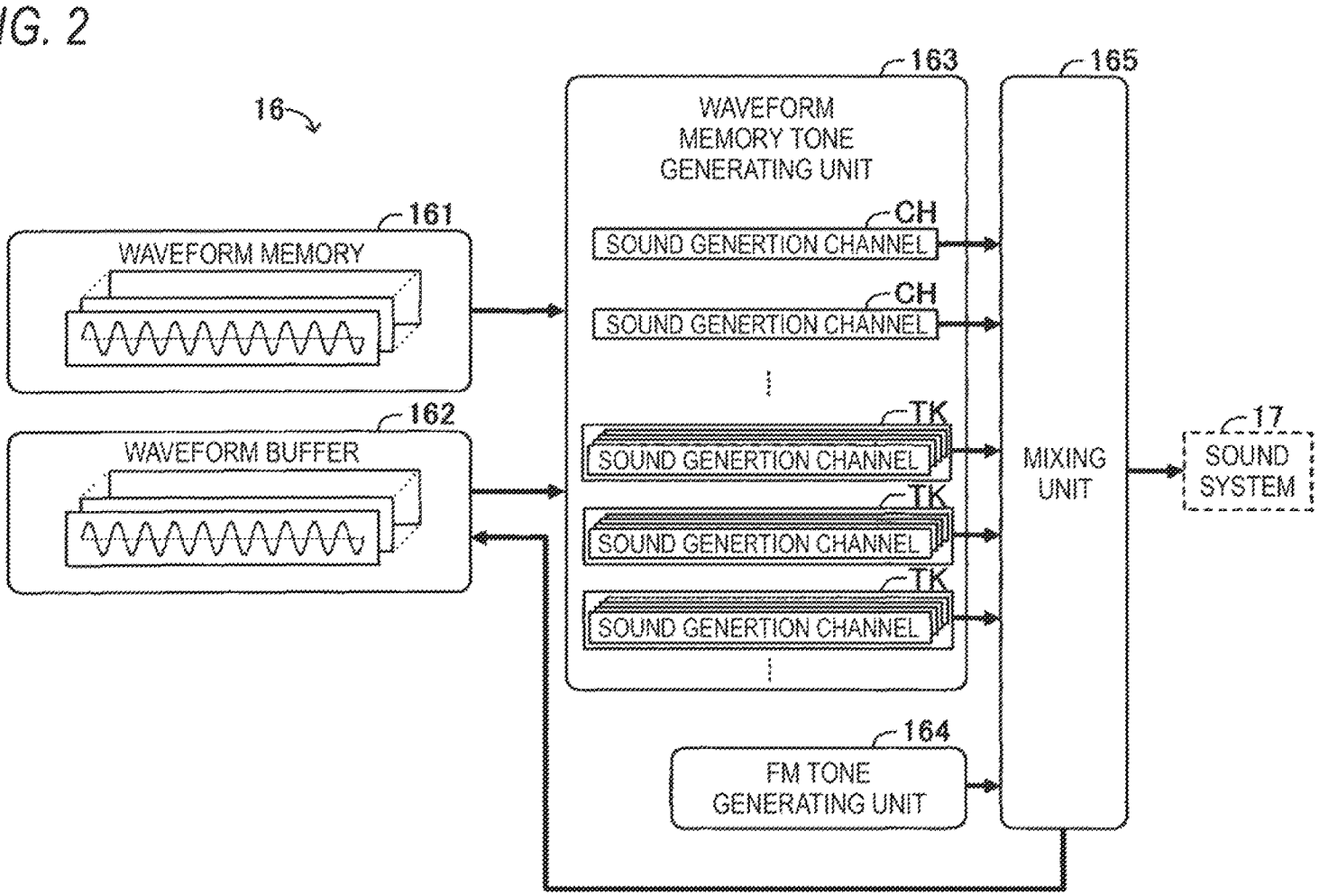
FIG. 2 is a block diagram showing the hardware configuration of a tone generating circuit.

An electronic musical instrument 10 which is a sound signal generating device according to an embodiment of the present disclosure will be described below. First, the electronic musical instrument 10 will be outlined. Similar to the electronic musical instrument of JP-A-2015-158527, as shown in FIG. 2, the electronic musical instrument 10 includes plural tracks for generating a new musical signal by cutting out plural segments from an original signal (i.e., waveform data representing an acoustic waveform of an original sound) and crossfading the segments. The new musical signal can be varied by varying track control parameters TP for controlling the tracks. The track control parameters TP include a parameter relating to the segments crossfading length, a parameter relating to the reading rate of samples constituting a segment, and a parameter relating to the segment length.

The parameter relating to the segments crossfading length corresponds to a parameter relating the pitch that is used in JP-A-2015-158527. That is, the parameter relating to the segment crossfading length corresponds to the degree or speed of moving the cutting position in the time axis direction of an original signal in cutting out segments from the original signal. The parameter relating to the reading rate of samples constituting a segment corresponds to the parameter relating to the formants that is used in JP-A-2015-158527. That is, the parameter relating to the reading rate of samples constituting a segment corresponds to the expansion/contraction ratio in the time axis direction of the segment.

The embodiment is different from the generating device of JP-A-2015-158527 in the following points. Whereas in the generating device of JP-A-2015-158527, the length, in the time axis direction, of a segment that is cut out from an original signal is synchronized with the cycle (a wavelength of a fundamental tone) of the original signal, in the embodiment the length of a segment may be different from the cycle of a fundamental tone of an original signal. That is, even if an original signal is periodic and its pitch is felt, the length of a segment need not always be synchronized with the cycle corresponding to the pitch.

Furthermore, in the electronic musical instrument 10, plural tracks can be connected in series. That is, a musical sound signal generated by one track can be used as an original signal for another track to generate a new musical sound signal. Still further, in the electronic musical instrument 10, a musical sound signal generated by one track can be fed back to the same track or a track located upstream of the one track. In this manner, a user can set a path for generation of a musical sound signal arbitrarily.

Figure 1:
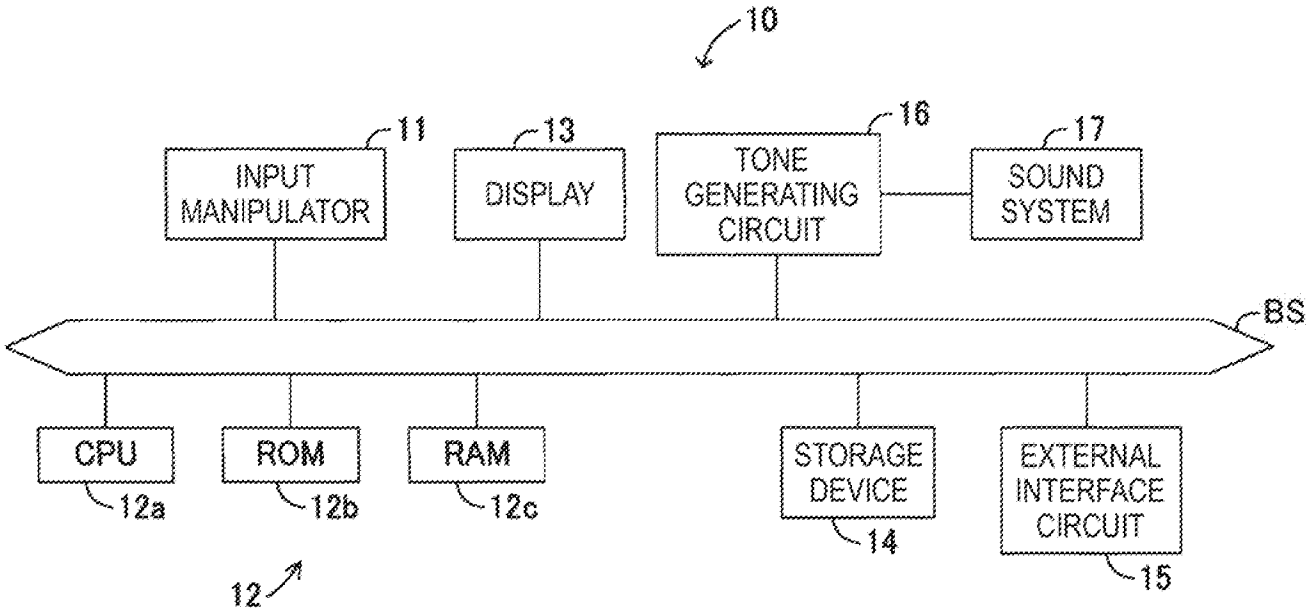
FIG. 1 is a block diagram showing a hardware configuration of an electronic musical instrument according to a first to third embodiments of the present disclosure.

Next, the configuration of the electronic musical instrument 10 will be described. As shown in FIG. 1, the electronic musical instrument 10 includes input manipulators 11, a computer unit 12, a display 13, a storage device 14, an external interface circuit 15, and a tone generating circuit 16, which are connected to each other by a bus BS. A sound system 17 is connected to the tone generating circuit 16.

The input manipulators 11 are a switch for turn-on/off manipulation, a volume for a rotational manipulation, a rotary encoder or switch, a volume for slide manipulation, a linear encoder or switch, a mouse, a touch panel, a keyboard device, etc. For example, a user commands a start or stop of sound generation using the input manipulators 11 (keyboard device). Furthermore, using the input manipulators 11, the user sets track control parameters TP, information indicating a manner of generation of a musical sound (sound volume, filtering, etc.), information (hereinafter referred to as path information) indicating a path for generation of a musical sound signal in the tone generating circuit 16 (described later), information for selection of waveform data to be employed as an original signal, and other information. Manipulation information (manipulator indication value) indicating a manipulation made on each of the input manipulators 11 is supplied to the computer unit 12 (described below) via the bus BS.

The computer unit 12 includes a CPU 12*a*, a ROM 12*b*, and a RAM 12*c* which are connected to the bus BS. The CPU 12*a* reads out various programs for controlling how the electronic musical instrument 10 operates from the ROM 12*b* and executes them. For example, the CPU 12*a* executes a program that describes an operation to be performed when each of the input manipulators 11 is manipulated and thereby controls the tone generating circuit 16 in response to a manipulation.

The ROM 12*b* is stored with, in addition to the above programs, initial setting parameters, waveform data information indicating information (start address, end address, etc.) relating to each waveform data, and various data such as graphical data and character data to be used for generating display data representing an image to be displayed on the display 13 (described below). The RAM 12*c* temporarily stores data that are necessary during running of each program.

The display 13, which is a liquid crystal display (LCD), is supplied with display data generated using figure data, character data, etc. from the computer unit 12. The display 13 displays an image on the basis of the received display data.

The storage device 14 includes nonvolatile mass storage media such as an HDD, an FDD, a CD, and a DVD and drive units corresponding to the respective storage media. The external interface circuit 15 includes a connection terminal (e.g., MIDI input/output terminal) that enables connection of the electronic musical instrument 10 to an external apparatus such as another electronic musical instrument or a personal computer. The electronic musical instrument 10 can also be connected to a communication network such as a LAN (local area network) or the Internet via the external interface circuit 15.

As shown in FIG. 2, the tone generating circuit 16 includes a waveform memory 161, a waveform buffer 162, a waveform memory tone generating unit 163, an FM tone generating unit 164, and a mixing unit 165. The waveform memory 161, which is a nonvolatile storage device (ROM), is stored with plural waveform data that represent acoustic waveforms of musical sounds, respectively. Each waveform data consists of plural sample values obtained by sampling a musical sound at a predetermined sampling cycle (e.g., 1/44,100 sec). On the other hand, the waveform buffer 162, which is a volatile storage device (RAM), is a ring buffer for storing waveform data (musical sound signal) temporarily.

The waveform memory tone generating unit 163 is configured in the same manner as a tone generating circuit used in JP-A-2015-158527. That is, the waveform memory tone generating unit 163 includes plural sound generation channels CH. Each sound generation channel CH reads out waveform data (original signal) from the waveform memory 161 and generates a new musical sound signal by processing the original signal according to instructions from the CPU 12*a*, and supplies the generated musical sound signal to the mixing unit 165. More specifically, each sound generation channel CH changes the pitch, volume, tone quality, etc. of an original signal.

In the electronic musical instrument 10, whereas an original signal can be processed by causing a sound generation channel CH to operate singly in the above manner, it is also possible to process an original signal by causing plural (e.g., four) sound generation channels CH as a single track TK. More specifically, according to instructions from the CPU 12*a*, the individual sound generation channels CH constituting a track TK read out, from the waveform memory 161, respective segments of one piece of waveform data in order starting from the beginning of the waveform data. A single musical sound signal is generated by crossfading the read-out segments and supplied to the mixing unit 165.

Figure 3:
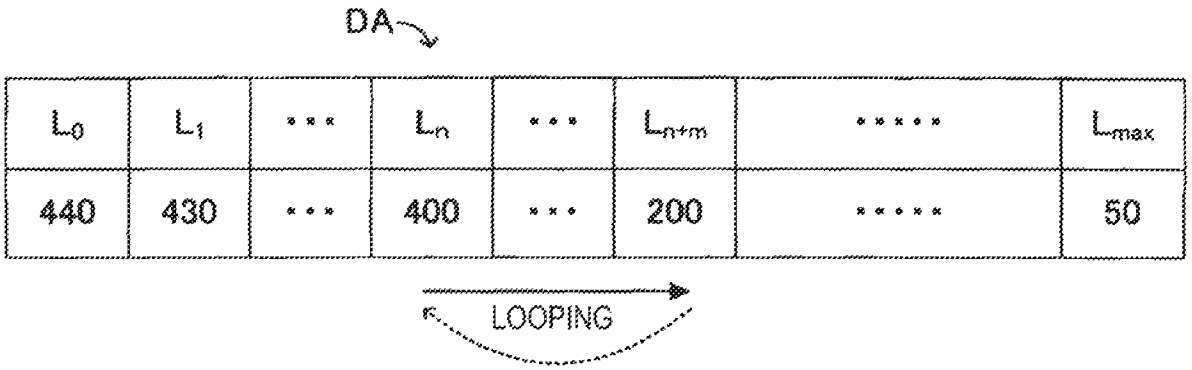
FIG. 3 is a table showing example segment length data.

In the embodiment, a data sequence DA as shown in FIG. 3 is used as parameters (segment defining data) for determining segment lengths of cutting-out of segments. The data sequence DA is set in advance and stored in the ROM 12*b*. The data sequence DA is constituted by segment length data $L_0, L_1, \ldots, L_{max}$ that represent half lengths (the numbers of samples) of respective segments. As mentioned above, even if an original signal is periodic and its pitch is felt, the segment length data $L_0, L_1, \ldots, L_{max}$ need not always correspond to the pitch. In the embodiment, the data sequence DA is set in such a manner that the segment length decreases gradually. However, the data sequence DA may be set in such a manner that the segment length increases gradually. A user selects plural adjoining segment length data $L_n, L_{n+1}, \ldots, L_{n+m}$ from the data sequence DA using the input manipulators 11. The CPU 12*a* supplies the plural selected segment length data $L_n, L_{n+1}, \ldots, L_{n+m}$ to a track TK sequentially. If the sum of the selected segment length data $L_n, L_{n+1}, \ldots, L_{n+m}$ is shorter than the length of the original data, the CPU 12*a* supplies the data sequence constituted by the segment length data $L_n, L_{n+1}, \ldots, L_{n+m}$ to the track TK repeatedly. The track TK may employ, as an original signal, waveform data that is stored in the waveform buffer 162.

The FM tone generating unit 164 is configured in the same manner as a known frequency modulation synthesis. The FM tone generating unit 164 generates a musical sound signal according to instructions (pitch, algorithm, feedback amount, etc.) from the CPU 12*a* and supplies the generated musical sound signal to the mixing unit 165.

The mixing unit 165 supplies musical sound signals received from the waveform memory tone generating unit 163 and the FM tone generating unit 164 to a downstream circuit according to path information that is set by the user. For example, the mixing unit 165 mixes musical sound signals received from the waveform memory tone generating unit 163 and the FM tone generating unit 164 and supplies a resulting signal to the sound system 17. For another example, the mixing unit 165 writes a musical signal received from a track TK of the waveform memory tone generating unit 163, the FM tone generating unit 164, or the like to the waveform buffer 162.

The waveform buffer 162 is divided into plural storage areas A1, A2, . . . , each of which can store 4,096 samples, for example. Path information (mentioned above) for generation of a musical sound signal includes information that specifies an area to which a musical signal is to be written.

Example paths for generation of a musical sound signal will be described in a specific manner with reference to FIGS. 4 and 5. In an example of FIG. 4, tracks $TK_1$ and $TK_2$ are connected in series. The track $TK_1$ generates a new musical sound signal by processing one piece of waveform data (original signal) stored in the waveform memory 161 according to instructions from the CPU 12*a*. For example, this original signal is a sinusoidal wave having a constant cycle. Each of the sound generation channels CH constituting the track $TK_1$ reads out a segment according to the track control parameters TP, and the track $TK_1$ generates a new musical sound signal by crossfading the read-out segments and supplies the generated musical sound signal to the mixing unit 165. The track $TK_1$ generates one sample value of the new musical sound signal in each sampling period (in synchronism with a sampling clock) and supplies it to the mixing unit 165.

The mixing unit 165 writes waveform data representing the musical sound signal received from the track $TK_1$ to a particular storage area (in the example of FIG. 4, a storage area A1) of the waveform buffer 162 according to path information for generation of a musical sound signal. Predetermined waveform data is written to the storage area A1 of the waveform buffer 162 in advance. More specifically, prior to a start of sound generation, particular waveform data (e.g., the original signal for the track $TK_1$) stored in the waveform memory 161 is copied to the storage area A1. The mixing unit 165 writes to the storage area A1 starting from a predetermined address (e.g., central address) of the storage area A1. When the writing address reaches the end of the storage area A1, the mixing unit 165 moves the writing address to the beginning of the storage area A1 and continues to write the waveform data. That is, the waveform data in the storage area A1 is overwritten (updated) successively.

The track $TK_2$ generates a new musical sound signal by employing, as an original signal, the musical sound signal represented by the waveform data stored in the storage area A1 of the waveform buffer 162 and processing the original signal according to instructions from the CPU 12*a*. More specifically, each of the sound generation channels CH constituting the track $TK_2$ reads out a segment according to the track control parameters TP, and the track $TK_2$ generates a new musical sound signal by crossfading the read-out segments and supplies the generated musical sound signal to the mixing unit 165. The mixing unit 165 supplies the musical sound signal receives from the track $TK_2$ to the sound system 17.

Figure 4:
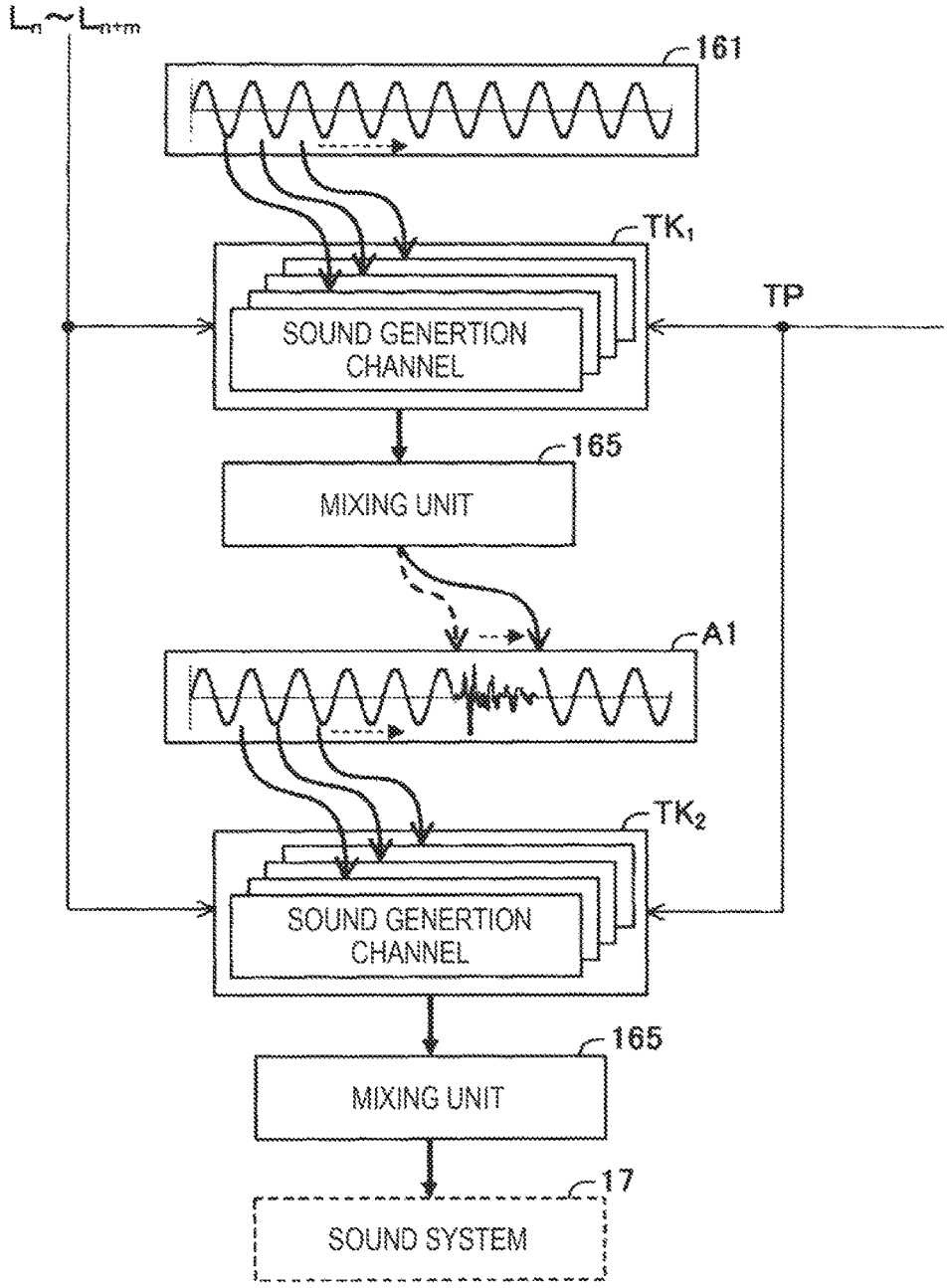
FIG. 4 is a block diagram showing an example path in which two tracks are connected in series.
Figure 5:
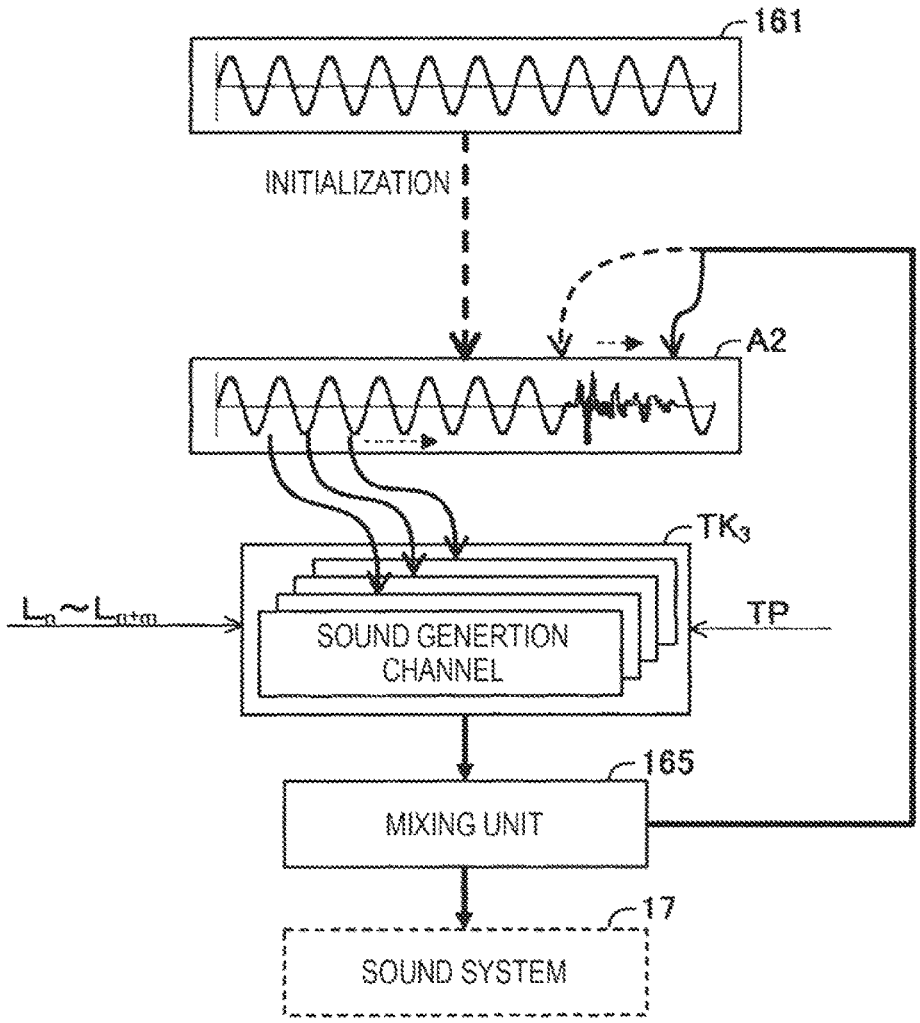
FIG. 5 is a block diagram showing an example path in which a musical sound signal that is output from a track is fed back to a storage.

In the example of FIG. 5, a musical sound signal generated by a track $TK_3$ is fed back to itself. More specifically, the track $TK_3$ generates a new musical sound signal by processing waveform data (original signal) stored in a particular storage area (in the example of FIG. 5, a storage area A2) of the waveform buffer 162 according to instructions from the CPU 12*a*. That is, each of the sound generation channels CH constituting the track $TK_3$ reads out a segment according to the track control parameters TP. And the track $TK_3$ generates a new musical sound signal by crossfading the read-out segments and supplies the generated musical sound signal to the mixing unit 165. As in the example of FIG. 4, predetermined waveform data is written to the storage area A2 in advance. The mixing unit 165 supplies the musical sound signal received from the track $TK_3$ to the sound system 17, and writes waveform data representing the received musical sound signal to the storage area A2 of the waveform buffer 162 according to the same procedure as in the example of FIG. 4.

Figure 6:
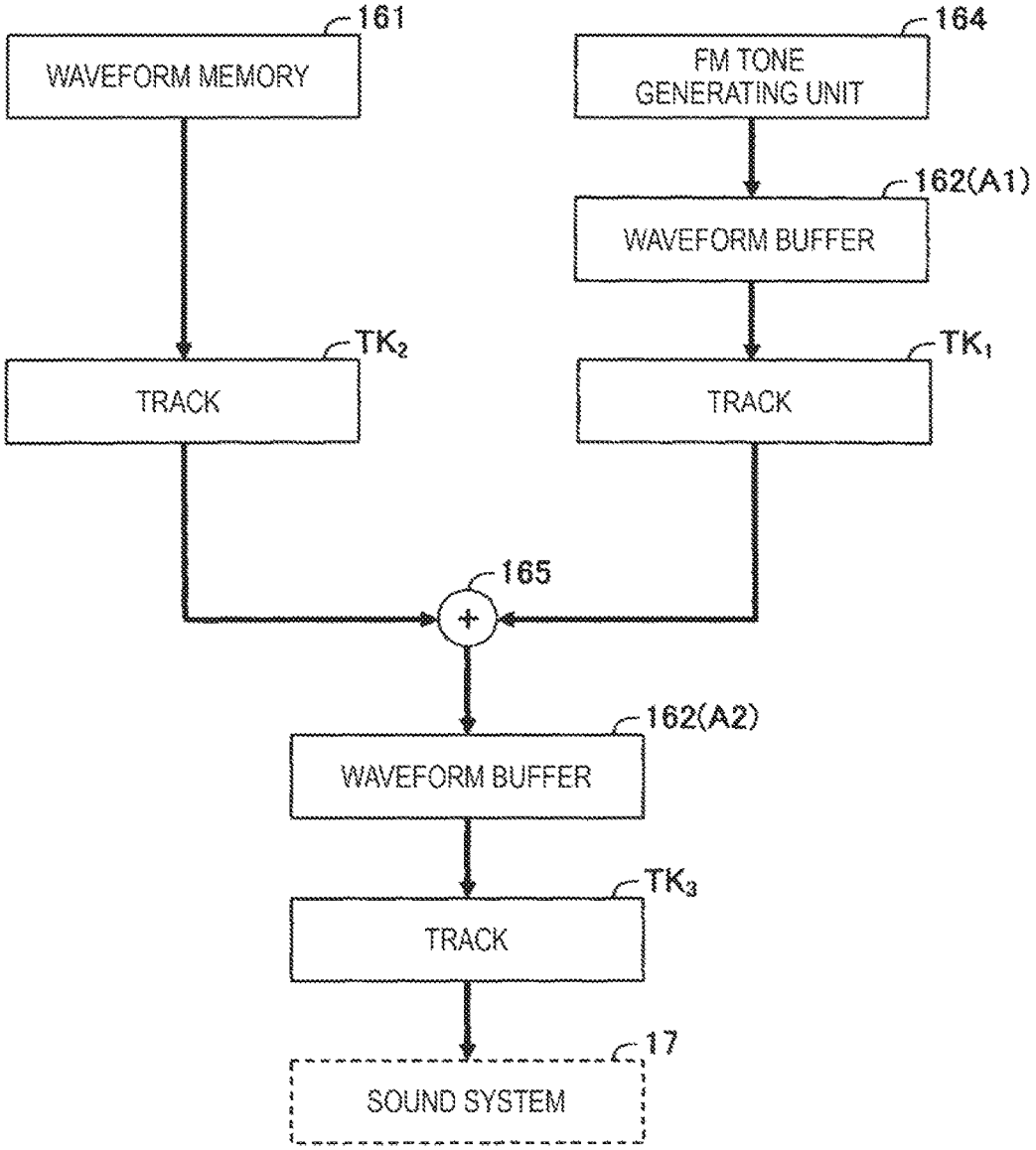
FIG. 6 is a block diagram showing an example path that is modified from the paths shown in FIGS. 4 and 5.
Figure 7:
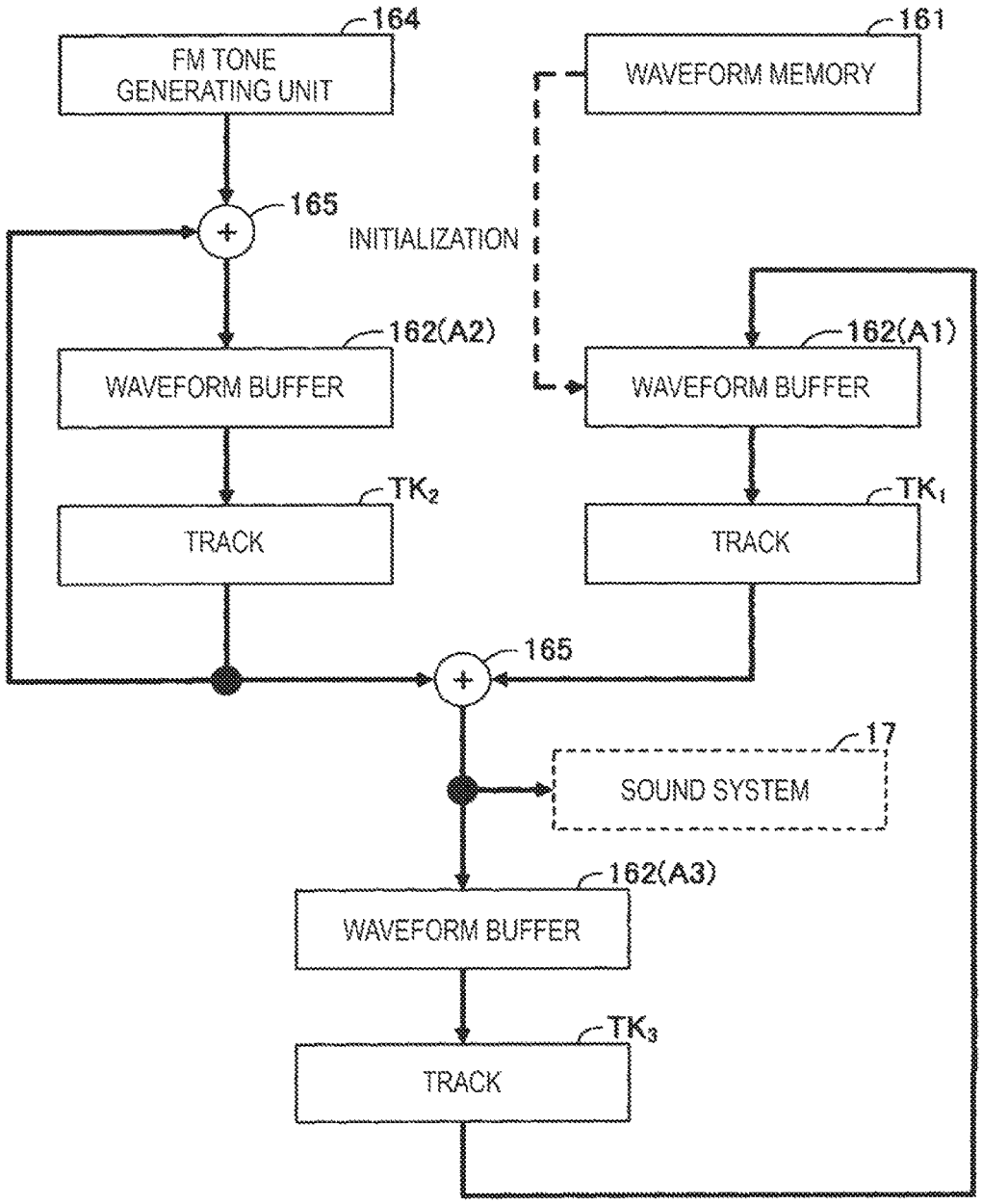
FIG. 7 is a block diagram showing another example path that is modified from the paths shown in FIGS. 4 and 5.

The example paths shown in FIGS. 4 and 5 are basic ones. Paths for generation of more complex musical sound signals as shown in FIGS. 6 and 7 can be formed by modifying the paths shown in FIGS. 4 and 5. That is, a user can connect a sound generation channel(s) CH, a track(s) TK, the FM tone generating unit 164, and the mixing unit 165 in a desired manner.

A musical sound signal that is supplied from the tone generating circuit 16 to the sound system 17 is a digital signal. The sound system 17 includes a D/A converter for converting the digital signal into an analog signal, an amplifier for amplifying the analog signal, and a pair of (left and right) speakers for converting the amplified analog signal into acoustic signals and emitting them.

In the above-described electronic musical instrument 10, tracks TK can be connected in series. In this case, a new musical sound signal is generated by processing an original signal by a track TK and then processed further by a track TK located downstream of the track TK.

A musical sound signal generated by a track TK can be feedback to itself (can be stored in itself). In this case, a musical sound signal supplied from another signal source (e.g., the FM tone generating unit 164, another track TK, or a sound generation channel that operates singly) and the musical sound signal generated by the track TK are added together and a resulting musical sound signal is employed as an original signal for the track TK.

It is not always the case that all the segment length data $L_0, L_1, \ldots, L_{max}$ that constitute the data sequence DA correspond to the cycle of a fundamental tone of an original signal. That is, there may occur a case that some pieces of segment length data L do not correspond to the cycle of the fundamental tone of the original signal. This makes it possible to generate an interesting musical sound signal that reflects the features of an original signal so some extent.

A user can designate part of the data sequence DA. And the designated range can be changed in real time. Furthermore, the same data sequence DA may be used in (i.e., shared by) plural tracks TK. In this case, either the same portion or different portions of the shared data sequence DA may be used.

The same track control parameters TP can be supplied to plural tracks TK. This allows a user to generate an interesting musical sound by varying the manner of generation of a musical sound merely by making relatively simple manipulations.

The present disclosure need not be practiced being restricted to the above embodiment, and various modifications are possible as long as the object of the disclosure is attained.

For example, although in the examples shown in FIGS. 4 to 7 the same track control parameters TP are supplied to the tracks TK, different sets of track control parameters TP may be generated for and supplied to the respective tracks TK.

In the example shown in FIG. 4, a data sequence DA constituted by segment length data $L_0, L_1, \ldots, L_{max}$ that correspond to the cycle of the fundamental tone of the original signal for the track $TK_1$ may be supplied to the tracks $TK_1$ and $TK_2$. In this case, whereas the data sequence DA constituted by segment length data $L_0, L_1, \ldots, L_{max}$ corresponds to the cycle of the fundamental tone of the original signal for the track $TK_1$, it does not correspond to the cycle of the fundamental tone of the original signal for the track $TK_2$. Thus, it is highly probable that an interesting musical sound can be obtained.

Although in the embodiment the data sequence DA is set in advance and stored in the ROM 12*b*, the electronic musical instrument 10 may be configured so that a data sequence DA can be set by a user at will. For example, it is possible to set plural kinds of data sequences DA and store them in the ROM 12*b* in advance and to allow a user to select one or plural ones of them. Furthermore, a user may be allowed to modify the values of segment length data L of the data sequence DA using the input manipulators 11.

Another type of tone generating unit (e.g., physical modeling synthesis type tone generating unit) may be provided in place of or in addition to the FM tone generating unit 164 of the tone generating circuit 16.

A configuration is possible in which the track control parameters TP can be changed by a user by manipulating manipulators that are connected to the external interface circuit 15.

The data sequence DA may be stored in the waveform memory 161. In this case, an appropriate configuration is such that a control unit in the tone generating circuit 16 supplies plural selected segment length data $L_0, L_1, \ldots, L_{max}$ to a track TK sequentially.

A configuration is possible in which plural data sequences that are similar to the data sequence DA are stored and a data sequence selected from the plural data sequences is assigned to each track TK.

In the examples shown in FIGS. 4 and 5 of the embodiment, predetermined waveform data is written to a predetermined storage area of the waveform buffer 162 prior to a start of sound generation. Alternatively, prior to a start of sound generation, the predetermined storage area may be made empty, that is, a predetermined value (e.g., 0's) may be written to the storage area.

Although the embodiment is directed to the instrument for generating a musical sound signal (waveform data), the disclosure is not limited to that case and can be implemented as an instrument for generating a signal representing an acoustic waveform of a sound other than a musical sound.

Here, the details of the above embodiments are summarized as follows.

In the following descriptions of respective components according to the present disclosure, the reference numerals and signs corresponding to the components according to embodiments to be described below are given in parentheses to facilitate understanding of the present disclosure. However, the respective components according to the present disclosure should not be limitedly interpreted as the components designated by the reference numerals and signs according to the embodiments.

The disclosure provides a content data generating device (10) comprising:

a first storage (161) configured to store content data including at least either video information or audio information;

a second storage (12*b*) configured to store variation data (DA) representing change of a parameter on the content data;

a designator (11,12*a*) configured to designate a portion of the variation data; and a content data generator (163) configured to process the content data according to a value of the parameter of the portion of the variation data designated by the designator to generate processed content data.

For example, the content data is waveform data representing a waveform of a sound signal, the variation data is a data sequence is constituted by plural segment defining data ($L_0, L_1, \ldots, L_{max}$) for defining plural segments respectively when the plural segments are cut out from the waveform data, the designator designates plural adjacent segment defining data of the plural segment defining data constituting the data sequence, and the content data generator cuts out the plural segments from the waveform data according to the designated plural segment defining data and cross-fades the plural segments to generate waveform data.

For example, the designator selects the plural adjacent segment defining data from the plural segment defining data constituting the data sequence and repeatedly designates a data sequence constituted by the selected plural segment defining data.

For example, a length of at least one of the plural segments is different from a cycle of a fundamental tone of the content data stored in the first storage.

For example, lengths of the plural segments are decreased or increased along in a time axis of the waveform data gradually.

The disclosure provides a sound signal generating device (10) comprising:

an adder (165) configured to acquire plural sound signals representing sound waveforms respectively and add the acquired sound signals together so that the acquired sound signals are superimposed on each other to generate waveform data representing a waveform of a sound signal;

a storage (162) configured to store the waveform data generated by the adder; and a sound signal generator (TK) configured to cut out plural segments, deviated from each other in a time axis of the waveform data, from the waveform data stored in the storage, and generate a sound signal on the basis of waveform data that is generated by crossfading the plural cut-out segments, wherein the sound signal generated by the sound signal generator or a sound signal generated using the sound signal generated by the sound signal generator is stored in the storage.

For example, waveform data has been stored in the storage in advance, and the storage configured to update the wave form data with waveform data representing the sound signal generated by the sound signal generator.

For example, the sound signal generator cuts out the plural segments on the basis of segment defining data that defines the plural segments respectively.

For example, a length of at least one of the plural segments is different from a cycle of a fundamental tone of a sound represented by the waveform data from which the plural segments are to be cut out.

According to the above configurations, a sound signal generated by the sound signal generator can be fed back to the storage. More specifically, a sound signal supplied from another signal source (e.g., another tone generating unit, another sound signal generator, or a sound generation channel that operates singly) and a sound signal generated by the sound signal generator are added together and a resulting sound signal is employed as an original signal for the sound signal generator. This makes it possible to generate an interesting musical sound having the features of an original signal to some extent.

There is provided a sound signal generating device (10) comprising:

a first sound signal generator ($TK_1$) configured to cut out plural segments, deviated from each other in a time axis of first waveform data, from the first waveform data representing a waveform of a sound signal and generate a sound signal on the basis of second waveform data that is generated by crossfading the plural cut-out segments of the first waveform data;

a storage (162) configured to store, as third waveform data, a waveform of the sound signal generated by the first sound signal generator; and a second sound signal generator ($TK_2$) configured to cut out plural segments, deviated from each other in the time axis of the third waveform data, from the third waveform data stored in the storage and generate a sound signal on the basis of fourth waveform data generated by crossfading the plural cut-out segments of the third waveform data.

According to the configuration, the first sound signal generator and the second sound signal generator are connected to each of other in series. More specifically, a new sound signal is generated by processing an original signal (waveform data) by the first sound signal generator and then processed by the second sound signal generator. This makes it possible to generate an interesting musical sound having the features of an original signal to some extent.

For example, the sound signal generating device further comprises a third sound signal generator configured to cut out plural segments, deviated from each other in a time axis of fourth waveform data, from the fourth waveform data representing a waveform of a sound signal and generate a sound signal on the basis of fifth waveform data that is generated by crossfading the plural cut-out segments of the fourth waveform data. The storage stores, as the third waveform data, a waveform of a sound signal obtained by mixing the respective sound signals generated by the first sound signal generator and the second sound signal generator.

For example, each of the first sound signal generator and the second sound signal generator cuts out the plural segments on the basis of plural segment defining data which define the plural segments respectively.

For example, a length of at least one of the plural segments is different from a cycle of a fundamental tone of a sound represented by the first waveform data or the third waveform data from which the plural segments are to be cut out.

For example, the same segment defining data are supplied to the first sound signal generator and the second sound signal generator.

This makes it possible to vary the form of a generated musical sound to a large extent merely by varying the one set of segment defining data.

For example, the sound signal generating device further comprises a fourth sound signal generator configured to generate a sound signal. The storage stores, as the third waveform data, a waveform of a sound signal obtained by mixing the respective sound signals generated by the first sound signal generator and the fourth sound signal generator.

There is provided a content data generating method of a content data generating device including a first storage storing content data including at least either video information or audio information and a second storage storing variation data representing change of a parameter on the content data, the content data generating method comprising:

designating a portion of the variation data; and processing the content data according to a value of the parameter of the portion of the variation data designated by the designator to generate processed content data.

For example, in the content data generating method, the content data is waveform data representing a waveform of a sound signal, the variation data is a data sequence is constituted by plural segment defining data for defining plural segments respectively when the plural segments are cut out from the waveform data, plural adjacent segment defining data is designated from the plural segment defining data constituting the data sequence in the designating process, and the plural segments are cut out from the waveform data according to the designated plural segment defining data and the plural segments are cross-faded to each other to generate waveform data.

For example, in the content data generating method, in the designating process, the plural adjacent segment defining data is selected from the plural segment defining data constituting the data sequence and a data sequence constituted by the selected plural segment defining data is repeatedly designated.

For example, in the content data generating method, a length of at least one of the plural segments is different from a cycle of a fundamental tone of the content data stored in the first storage.

For example, in the content data generating method, lengths of the plural segments are decreased or increased along in a time axis of the waveform data gradually.

There is provided a sound signal generating method comprising:

acquiring plural sound signals representing sound waveforms respectively;

adding the acquired sound signals together so that the acquired sound signals are superimposed on each other to generate waveform data representing a waveform of a sound signal;

storing the waveform data generated in the adding process in a storage;

cutting out plural segments, deviated from each other in a time axis of the waveform data, from the waveform data stored in the storage;

generating a sound signal on the basis of waveform data that is generated by crossfading the plural cut-out segments; and storing the sound signal generated in the generating process or a sound signal generated using the sound signal generated in the generating process in the storage.

For example, in the sound signal generating method, waveform data has been stored in the storage in advance, and the wave form data is updated with waveform data representing the sound signal generated in the generating process.

For example, in the sound signal generating method, the plural segments are cut out on the basis of segment defining data that defines the plural segments respectively.

For example, in the sound signal generating method, a length of at least one of the plural segments is different from a cycle of a fundamental tone of a sound represented by the waveform data from which the plural segments are to be cut out.

There is provided a sound signal generating method comprising:

cutting out plural segments, deviated from each other in a time axis of first waveform data, from the first waveform data representing a waveform of a sound signal generating a sound signal on the basis of second waveform data that is generated by crossfading the plural cut-out segments of the first waveform data;

storing, as third waveform data, a waveform of the sound signal generated in the generating process in a storage; and cutting out plural segments, deviated from each other in the time axis of the third waveform data, from the third waveform data stored in the storage; and generating a sound signal on the basis of fourth waveform data generated by crossfading the plural cut-out segments of the third waveform data.

For example, in the sound signal generating method, in each of the sound signal generating processes, the plural segments are cut out on the basis of plural segment defining data which define the plural segments respectively.

For example, in the sound signal generating method, the same segment defining data are used in both of the sound signal generating processes.

For example, in the sound signal generating method, a length of at least one of the plural segments is different from a cycle of a fundamental tone of a sound represented by the first waveform data or the third waveform data from which the plural segments are to be cut out.

For example, the sound signal generating method further comprises:

cutting out plural segments, deviated from each other in a time axis of fourth waveform data, from the fourth waveform data representing a waveform of a sound signal; and generating a sound signal on the basis of fifth waveform data that is generated by crossfading the plural cut-out segments of the fourth waveform data, wherein the storage stores, as the third waveform data, a waveform of a sound signal obtained by mixing the respective sound signals generated by the sound signal generating process of the sound signal based on the second waveform data and the sound signal generating process of the sound signal based on the fourth waveform data.

For example, the sound signal generating method further comprises:

generating a sound signal, wherein the storage stores, as the third waveform data, a waveform of a sound signal obtained by mixing the respective sound signals generated by the sound signal generating process of the sound signal based on the second waveform data and the generating process of the sound signal.

What is claimed is:

1. A content data generating device comprising:

a first storage configured to store content data including at least either video information or audio information;

a second storage configured to store variation data representing change of a parameter on the content data;

a designator configured to designate a portion of the variation data; and a content data generator configured to process the content data according to a value of the parameter of the portion of the variation data designated by the designator to generate processed content data, wherein the content data is waveform data representing a waveform of a sound signal;

wherein the variation data is a data sequence is constituted by plural segment defining data for defining plural segments respectively when the plural segments are cut out from the waveform data, wherein the designator designates plural adjacent segment defining data of the plural segment defining data constituting the data sequence, and wherein the content data generator cuts out the plural segments from the waveform data according to the designated plural segment defining data, cross-fades the plural segments to generate waveform data, and writes the generated waveform data to the first storage.

2. The content data generating device according to claim 1, wherein the designator selects the plural adjacent segment defining data from the plural segment defining data constituting the data sequence and repeatedly designates a data sequence constituted by the selected plural segment defining data.

3. The content data generating device according to claim 1, wherein a length of at least one of the plural segments is different from a cycle of a fundamental tone of the content data stored in the first storage.

4. The content data generating device according to claim 1, wherein lengths of the plural segments are decreased or increased along in a time axis of the waveform data gradually.

5. The content data generating device according to claim 1, wherein the content data generator mixes the generated waveform data and waveform data received from a FM tone generator and writes the mixed waveform data to the first storage.

6. A content data generating method of a content data generating device including a first storage storing content data including at least either video information or audio information and a second storage storing variation data representing change of a parameter on the content data, the content data generating method comprising the steps of:

designating a portion of the variation data; and processing the content data according to a value of the parameter of the portion of the variation data designated by the designator to generate processed content data, wherein the content data is waveform data representing a waveform of a sound signal;

wherein the variation data is a data sequence is constituted by plural segment defining data for defining plural segments respectively when the plural segments are cut out from the waveform data, wherein the designator designates plural adjacent segment defining data of the plural segment defining data constituting the data sequence, and wherein the content data generator cuts out the plural segments from the waveform data according to the designated plural segment defining data, cross-fades the plural segments to generate waveform data, and writes the generated waveform data to the first storage.

7. The method according to claim 6, wherein the processing step mixes the generated waveform data and waveform data received from a FM tone generator and writes the mixed waveform data to the first storage.

* * * * *